United States Patent [19]

Schuegraf

[11] 4,319,206

[45] Mar. 9, 1982

[54] TRANSDUCER FOR ORTHOGONALLY POLARIZED SIGNALS OF DIFFERENT FREQUENCIES

[75] Inventor: Eberhard Schuegraf, Munich, Fed. Rep. of Germany

[73] Assignee: Siemens Aktiengesellschaft, Berlin & Munich, Fed. Rep. of Germany

[21] Appl. No.: 93,676

[22] Filed: Nov. 13, 1979

Related U.S. Application Data

[63] Continuation of Ser. No. 872,602, Jan. 26, 1978, abandoned.

[30] Foreign Application Priority Data

Jan. 31, 1977 [DE] Fed. Rep. of Germany ..... 2703878

[51] Int. Cl.[3] ..... H01P 1/161; H01P 5/19

[52] U.S. Cl. ..... 333/126; 333/135; 333/21 A; 333/254

[58] Field of Search ..... 333/21 A, 135, 137, 333/109, 110, 117, 122, 126

[56] References Cited

U.S. PATENT DOCUMENTS

| | | | |
|---|---|---|---|
| 3,731,235 | 5/1973 | DiTullio et al. | 333/135 |
| 3,731,236 | 5/1973 | DiTullio et al. | 333/21 A X |
| 3,978,434 | 8/1976 | Morz et al. | 333/135 |
| 4,030,048 | 6/1977 | Foldes | 333/21 A X |
| 4,047,128 | 9/1977 | Morz | 333/122 X |

*Primary Examiner*—Paul L. Gensler

*Attorney, Agent, or Firm*—Hill, Van Santen, Steadman, Chiara & Simpson

[57] ABSTRACT

In the illustrated embodiments a dual branching is coupled to two simple branchings via coupling elements which are rotationally symmetrical so as to accommodate different spacial dispositions of the two simple branchings while maintaining electrically completely symmetrical passageways and consequent phase synchronism therein. When the dual branching is connected with an antenna for directional or satellite broadcasting operations, the sending and receiving frequencies, with respective polarizations at the respective simple branchings, may be separated with the use of a bandpass arrangement and 3-dB directional couplers for the respective separated frequencies.

15 Claims, 12 Drawing Figures

FIG. 9
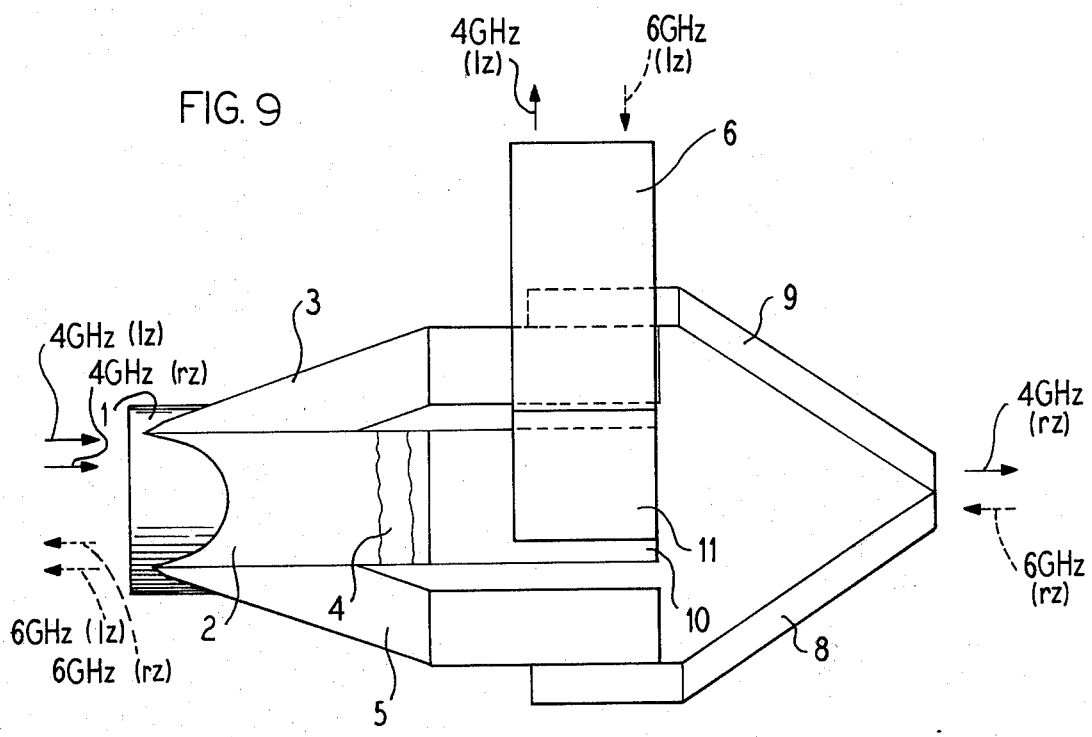
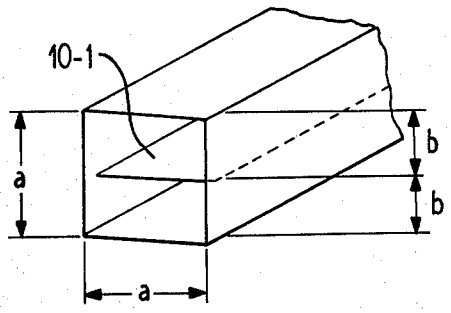
FIG. 10
FIG. 11
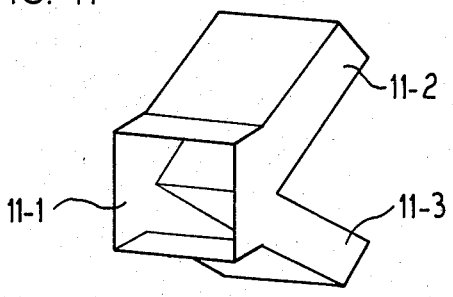
FIG. 12
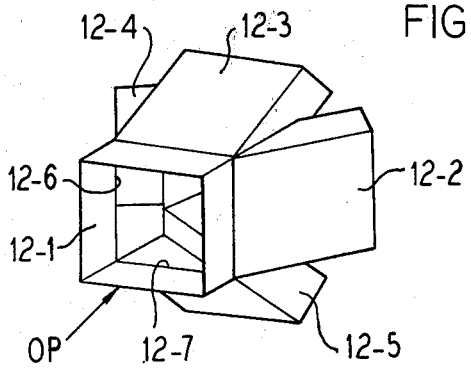

TRANSDUCER FOR ORTHOGONALLY POLARIZED SIGNALS OF DIFFERENT FREQUENCIES

This is a continuation of application Ser. No. 872,602, filed Jan. 26, 1978, now abandoned.

BACKGROUND OF THE INVENTION

The invention relates to a transducer for orthogonally polarized signals, for high frequency installations particularly for antenna feeder systems, for example in the directional and satellite broadcasting operations with hollow conductor sections of rectangular and/or circular cross-section, comprising a symmetrically designed five-arm branching (dual branching) which contains a first arm located in the longitudinal axis of the arrangement for the connection of an extension hollow conductor (or waveguide) of circular or square cross-section and four homogeneously designed partial arms which in each case are arranged offset by 90° relative to each other and extending in the opposite direction to the first arm at an identical angle in each case relative to the longitudinal axis of the arrangement and with two partial arms located opposite each other, being connected in each case via switch arm sections which are identical with regard to each other to the partial arms of homogeneously designed symmetrical simple branches.

An important area of application of such transducers for orthogonally polarized signals, known for example from the German Publication Copy 25 21 956, is satellite broadcasting where the available transmitting and receiving frequency bands are occupied with double polarization and thus at identical band width they can be utilized twofold. For an antenna feeder system a transducer then is demanded where both its passageways are of low reflection in the transmitting and in the receiving band and they are to be in phase synchronization. The problem posed here is solved for the first time now by the German Publication Copy 25 21 956, namely to assure for both passageways of a transducer for orthogonally polarized signals (hereafter referred to as a "polarization switch") in all frequencies of two desired frequency ranges which are far apart from each other in frequency an agreeing electrical length in all cases. With the switch design proposed there, however, due to the remaining asymmetry in the design of two passageways different from each other a special phase compensation is required there by which the differential phase paths of the hollow conductor elbows on the one hand and of the straight hollow conductors on the other hand must be equalized.

Furthermore, a system switch is known from the German Publication Copy 24 43 166 for separating two signals consisting of doubly polarized frequency bands, where, however, no phase-symmetical design exists and thus a combination by means of 3-dB direction couplers to one antenna feeder system for circular dual polarization is not possible. Another disadvantage of this system switch also resides in the fact that the differential electrical lengths of its two outputs must be corrected with a special phase equalization circuit. As a result of the longitudinal beam release a relatively low performance load capacity results for such a switch.

Consequently, the invention is based on the problem of offering a solution for a polarization switch which assures that both passageways of the polarization switch are exactly in phase synchronization at all frequencies of two desired frequency ranges spaced far apart from each other, and which also makes possible in both frequency ranges a good broadband adjustment.

SUMMARY OF THE INVENTION

Starting out from a polarization switch for high frequency installations particularly for antenna feeder systems, for example in the directional and satellite broadcasting operations with hollow conductor sections of rectangular and/or circular cross-section, comprising a symmetrically designed five-arm branching (dual branching) which contains a first arm located in the longitudinal axis of the arrangement for the connection of an extension hollow conductor of circular or square cross-section and four homogeneously designed partial arms offset by 90° relative to each other in each case and extending generally in an opposite direction from the first arm at an identical angle in each case relative to the longitudinal axis of the arrangement and with two partial arms located opposite each other being connected in each case via switch arm sections (which are identical with regard to each other) to the partial arms of homogeneously designed symmetrical simple branches, this problem is solved according to the invention in that all switch arm sections located between the partial arms of the dual branching and the simple branching are provided with coupling installations which are identical among each other and of identical design with regard to each other and so dimensioned that a completely symmetrical structure and phase synchronization will result for both passageways of the arrangement.

The invention is based on the realization that a precise phase symmetry can be accomplished for all frequencies of two frequency ranges spaced relatively far apart from each other only by a completely symmetrical switch design. The advantage of such polarization switches symmetrical in structure, according to the invention resides in the fact that the degree of their phase symmetry only is a function of the precision of manufacturing and controllable by correspondingly low manufacturing tolerances at any desired degree of precision.

An advantageous embodiment of the teaching of the invention results from the fact that the partial arms of the dual branching are designed as hollow conductors (waveguides) of rectangular cross-section with a side relation b:a of at least approximately 1:2 to 1:3, that the simple branchings are designed as series branchings with hollow conductor partial arms of rectangular cross-section, and that the switch arm sections located between the partial arms of the dual branching and the simple branching are formed in each case by two parallel hollow conductor sections arranged immediately juxtaposed and coupled to each other by a coupling system, and that the coupling installation is of such rotation-symmetrical design that in case of a reciprocal rotation of the hollow conductor (or waveguide) sections about the axis of the coupling installation the electrical length of the passageways of the arrangement remains intact.

An advantageous improvement of the subject of the invention results from the fact that the partial arms of the double branching are designed as hollow conductors (or waveguides) or rectangular cross-section with a side ratio b:a of at least approximately 1:2 to 1:3, that the simple branchings are designed as coaxial parallel branchings with coaxial partial arms and that the switch arm sections located between the partial arms of the double branching and the coaxial arms of the simple branching contain in each case a rectangular hollow conductor connected to one partial arm of the dual branching and a coaxial conduit extending adjacent to said rectangular hollow conductor, that each coaxial lateral arm is connected on the one hand via an angle piece to one of the coaxial partial arms of the simple branching and on the other hand via a coupling installation to the rectangular hollow conductor, and that for each of both passageways of the arrangement the one coaxial lateral arm is adjacent to one side of the one rectangular hollow conductor located on the outside with regard to the longitudinal axis of the arrangement, and the other coaxial lateral arm is adjacent to the side of the other rectangular hollow conductor located on the inside with regard to the longitudinal axis of the arrangement. In such an embodiment the constructional length of the switch is reduced to a minimum.

It is advantageous that the symmetrical structure of the switch even is maintained when the simple branchings are pivoted within the scope of the topological possibilities about a coupling arrangement designed as mechanical revolving turrent and directed with regard to their axis of rotation perpendicularly to the longitudinal axis of the arrangement.

An advantageous improvement of the idea of the invention embodying an antenna feeder system results in that the partial arms of the dual branching extend parallel side by side and are designed as hollow conductors (waveguides) of circular sector shape in cross-section, that adjacent partial arms of the dual branching in each case have a common partition and outer walls supplementing each other to define a circular cross-section, that the simple branchings are designed as series branches with hollow conductor partial arms of rectangular cross-section, and that the switch arm sections located between the partial arms of the dual branching and the simple branching are designed as rectangular hollow conductor (waveguide) sections arranged with one of their broad sides in each case adjacent to diametrically opposite points of the outer walls of two opposite partial arms of the dual branching in each case and connected via coupling installations at these points to the opposite partial arms.

Below the invention is explained more in detail by way of embodiments exemplified in the accompanying sheets of drawings; other objects, features and advantages will be apparent to those skilled in the art from this detailed disclosure and from the appended claims.

BRIEF DESCRIPTION OF THE DRAWINGS

FIG. 9 is a somewhat diagrammatic side elevational view of the polarization switch of FIG. 1; and FIGS. 10, 11 and 12 correspond to the second, third and fourth figures of German Offenlegungsschrift 25 21 956 and are for the purpose of illustrating prior art background with respect to the dual branching of FIGS. 1, 2 and 9.

DETAILED DESCRIPTION

Figure 1:
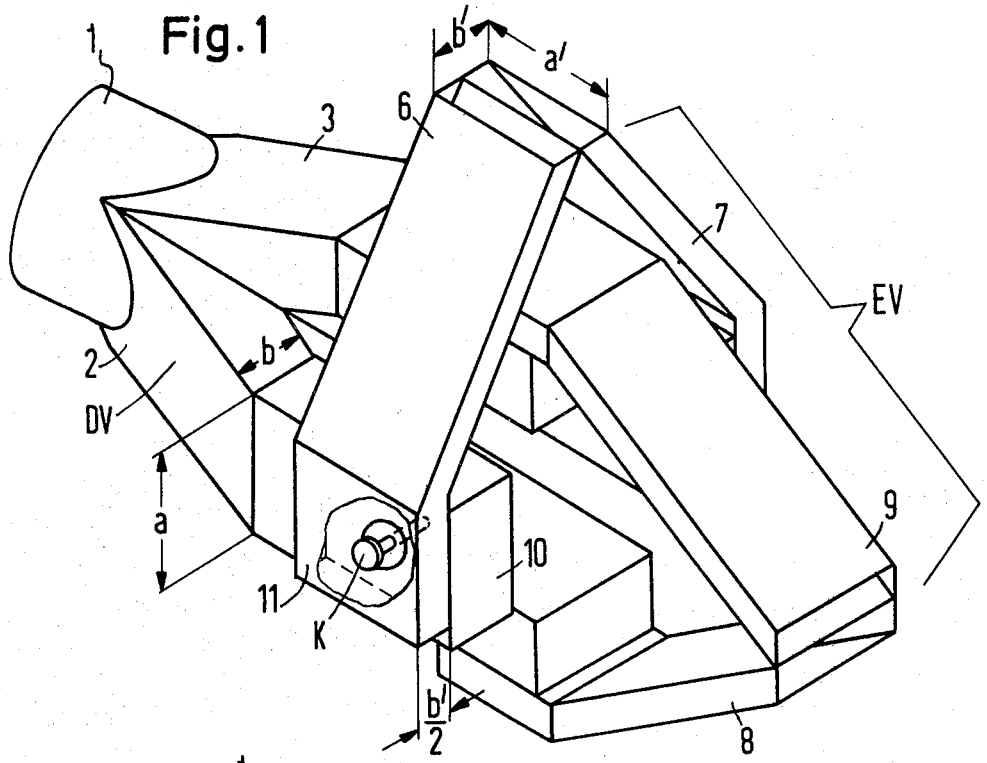
FIG. 1 shows an embodiment of a polarization switch according to the invention.

For the illustration of the structure of the embodiment according to FIG. 1, let us first consider the symmetrically designed five-arm branching represented in the left portion of the figure, hereinafter called dual branching DV. Such a dual branching already is known as component of the polarization switch according to the German Publication Copy 25 21 956, and FIGS. 2, 3 and 4 of the German Publication 25 21 956 are reproduced as FIGS. 10, 11 and 12 of the present drawings for the sake of background. The description of FIGS. 10, 11 and 12 as found in the German publication is reproduced in the following section with minor revisions to facilitate the application of reference numerals.

Description of the Prior Art Dual Branching OP With the Aid of FIGS. 10–12

In order to illustrate the construction of the polarization switch according to FIGS. 1 and 9, a few development stages of a prior art symmetrical, five-arm branching (orthogonal polarizer OP) are illustrated in FIGS. 10 through 12. Thereby, FIG. 10 proceeds from a square waveguide cross-section which is halved by a very thin plate 10-1 in a horizontal plane. By so doing, two rectangular waveguides with the normal side ratio b:a=1:2 arise. Concerning this arrangement, it is known that it is adapted for a vertically polarized $H_{10}$-wave and is, moreover, reactance-free. Therefore, it is non-reflecting in a broad band. This branching still remains very low-reflecting even when the square waveguide is replaced by means of a round waveguide (given the same limiting frequency) with the same line waveguide impedance, because the inductive and capacitive leakage reactances at the abrupt junction from the square to the round waveguide largely compensate broad-band.

In accordance with FIG. 11, the two rectangular waveguides of FIG. 10 can be symmetrically bent apart at the location where the divider begins to provide a common section 11-1 and branch sections 11-2 and 11-3. But in so doing, an inductive reactance arises at the bend which yields a reflection factor of $r_E$ on the order of 3% for an angle of 35 degrees, which reflection factor can be compensated broad-band by means of a correspondingly small capacitance of the bend.

If the simple series branching according to FIG. 11 is augmented by means of a second series branching identical to the first but which is turned by 90° from the plane of the first series branching about the longitudinal axis of the arrangement and is attached on the longitudinal axis in the same position as the first branching, then one achieves the five-arm branching illustrated in FIG. 12 with a longitudinal common arm 12-1 and four partial arms 12-2, 12-3, 12-4 and 12-5. This branching is completely symmetrical for the rectangular waveguide pairs 12-2 and 12-4, and 12-3 and 12-5 lying opposite one another. One can conceive of this branching being produced in that four equal rectangular branches such as 12-6 and 12-7, FIG. 12, are introduced into a right parallelepiped with a uniform angle with respect to its center line, which branches are offset by 90° with respect to one another with reference to the symmetry axis of the arrangement (identical with the axis of the initial waveguide).

Because of the mutual penetration of the rectangular waveguides 12-2, 12-3, 12-4, and 12-5, these waveguides have openings in the juncture at both side walls which lead to a scattering of magnetic fields, corresponding to an inductive reactance. Since this reactance arises in the same manner in all four rectangular waveguides, these four inductances can be compensated broad-band by means of a symmetrical capacitance. This compensation can be realized, for example, in such manner that a screw whose head is disc-shaped or cylindrical is inserted in the apex of the pyramid arising in the center of the branching, so that the location and magnitude of the capacitance can be precisely adjusted.

Description of the Embodiment of FIGS. 1 and 9

The transducer of FIGS. 1 and 9 comprises a first arm 1 located in the longitudinal axis of the arrangement designed cylindrically in this embodiment and provided for the connection of an extension waveguide of circular or square cross-section, also of four homogeneously designed partial arms 2, 3, 4 and 5, offset in each case by 90° in relation to each other and extending at identical angles in each case relative to the longitudinal axis of the arrangement and generally in an opposite direction to the first arm 1. In this embodiment these partial arms 2–5 of the dual branching have a rectangular cross-section and the pairs of rectangular hollow conductors 2 and 4, and 3 and 5 which are placed opposite each other in each case, are entirely symmetrical. In the representation according to FIG. 1, the partial arms 4 and 5 are covered by the partial arms 2 and 3, and thus, for reasons of clarity they are not shown separately in FIG. 1; in FIG. 9, however, partial arm 5 is shown in side elevation, and a portion of partial arm 2 is broken away so as to expose a portion of the symmetrically disposed partial arm 4. As described in reference to FIG. 12 in the preceding section, with respect to the dual branching OP with a square waveguide common section 12-1, it is imaginable to consider this dual branching DV also produced in such a manner that in a cube four identical rectangular openings are applied at a uniform angle relative to the central axis which openings are offset relative to each other with reference to the axis of symmetry of the arrangement (identical with the axis of the hollow output conductor) by 90° in each case.

The two partial arms placed opposite each other in each case, namely 2 and 4 and/or 3 and 5 of the dual branching DV preferably are connected via switch arm sections (such as 10 and 11) explained more in detail below, in pairs to the partial arms 6 and 7 and/or 8 and 9 of one simple branching EV likewise known from German Publication Copy 25 21 956 in connection with a polarization switch and of homogeneous design with regard to each other. In the embodiment according to FIG. 1 such a simple branching consists of two rectangular hollow conductors originally superposed on their broad sides (as indicated in FIG. 11) which at the point where the partition commences are bent apart sharply and symmetrically. Thus, a small inductive reactance is created at the point of the sharp bend which for example for an angle of 35° in each case will produce a reflection factor of about 3% which can be compensated, over a broad band, however, by a correspondingly low capacity of the bending point. Thus this is in each case a simple series branching, whereby in this embodiment the partial arms 8 and 9 of the series branching connected to the dual branching DV are oriented symmetrically to the longitudinal axis of the arrangement.

In order to accomplish a precise phase synchronism for both passageways of the polarization switch, all switch arm sections (such as 10 and 11) located between the partial arms 2, 4, and/or 3, 5 of the dual branching DV and the partial arms 6, 7, and/or 8, 9 of the simple branching as well as the coupling installations such as K provided within these switch arm sections are identical in design with regard to each other, so that a completely symmetrical design results on the whole which with regard to the feeding rectangular hollow conductor inlets is free from spacial interferences. In the embodiment according to FIG. 1 this is accomplished in that the switch sections located between the partial arms 2–5 of the dual branching DV and the simple branchings 6, 7 and 8, 9 are formed in each case by two parallel hollow conductor sections 10, 11 arranged immediately juxtaposed and coupled together by means of a coupling system K. It is important in this respect that these hollow conductor sections are equally dimensioned in each case for all partial arms 2–5 and/or for both passage paths of the polarization switch. In the embodiment these hollow conductors are designed as rectangular hollow conductors 10 and 11 superposed with their broad side, whereby the rectangular hollow conductor 10 immediately follows the partial arm 2 of the dual branching DV and is extended parallel with the longitudinal axis of the arrangement.

In the arrangement represented in FIG. 1 where the two coupling installations placed opposite each other of the one of the two passage paths of the arrangement are so turned that the central axis of the partial arms 6 and 7 of the associated simple branching is oriented perpendicularly to the longitudinal axis of the arrangement, while in the other passageway a stretched design is present in the direction of the axis of the arrangement, both passageways thus have agreeing electrical properties. Hence, the entire switch according to FIG. 1 is completely symmetrical in its design. This symmetry even is preserved when either series branching is pivoted about the associated coupling installations as axis within the scope of the topological possibilities.

The wave impedance transformation is intended as a further function for the hollow conductor sections 10, 11. The hollow conductor section 10 leading to the dual branching is adjusted to have a side ratio b:a of from about 1:2 to about 1:3 which prevails there. The other hollow conductor section 11 of the distortable (structurally relatively movable) hollow conductor connection has the same broad side a' as the switch inlet via the series branchings EV, but only half the height b'/2 of the total height b' present there. However, the broad side a' of these series branchings need not be equal to the broad side a of the partial arms 2, 3, 4, 5 of the dual branching. The wave impedance transition from the partial arm cross-section of the dual branching DV to the half-high series branching cross-section is accomplished by the optimal coupling in each case to these two hollow conductors by probes, coupling holes and/or additional measures as they are known for example from the Vest-Pocket Booklet of High Frequency Technique, 2nd volume, page 420 by Meinke, Gundlach. These couplings operate in an even more broadbanded manner with hollow conductors of correspondingly smaller height as they exist in the present case.

It is particularly advantageous that in the switch arrangement according to the invention, a previously necessary adjustment of the hollow conductor elbows (for example as in a switch according to the German Publication Copy 25 21 956), a phase compensation and an adjustment of the wave impedance transformers are eliminated, so that only the broad band adjustment of the flexible hollow conductor connections is to be considered. However, for this the data known from the above cited literary passage (Meinke) are usable without problems for optimal dimensioning of hollow conductor coaxial conduit transfers, as well as the optimal dimensioning of the short coaxial conduit resulting therefrom between the distortable hollow conductors as to length and impedance or also for the optimal dimensioning of revolving turrets for high passage performance in at least one of the two operating frequencies. All additional components of the switch, namely the dual branching and the series branchings are adjusted in a broadband manner basically. This also results from a measurement of the reflection factor which in both frequency ranges of 3.7 to 4.2 GHz and 5.9 to 6.4 GHz is below 10% and thus sufficiently low.

Figure 2:
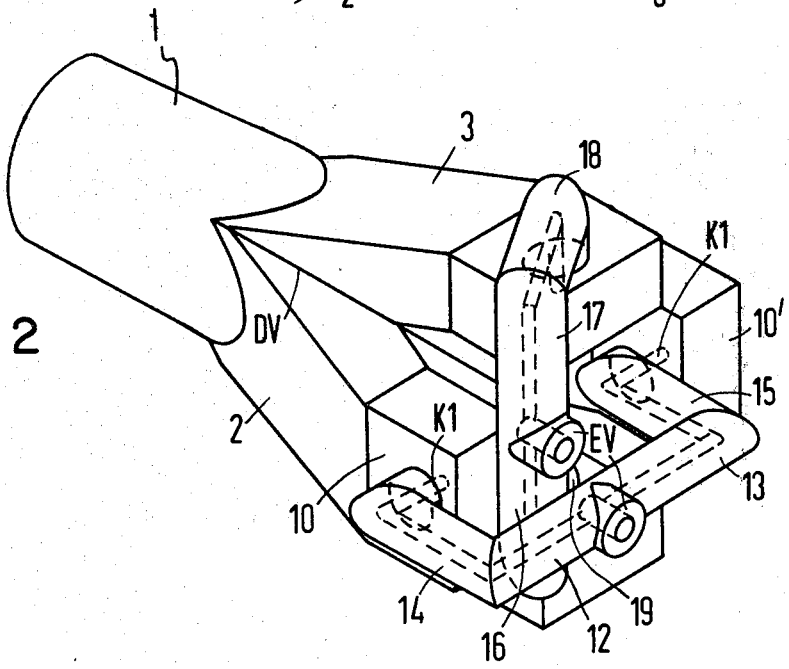
FIG. 2 shows a polarization switch according to the invention of compact constructional length with coaxial branchings.

FIG. 2 shows another, likewise completely symmetrical embodiment of the polarization switch according to the invention, using the same dual branching DV as in the switch according to FIG. 1. The four partial arms 2, 3, 4, 5, of the dual branching DV designed as rectangular hollow conductors, however, are combined in pairs in coaxial technique inphase as follows into a simple branching EV likewise designed in coaxial technique. Since this simple branching is a parallel branching and not a series branching as in FIG. 1, a phase shifting by 180° in a phase-independent manner as explained below, of both wave guide modes relative to each other is required.

In the embodiment according to FIG. 2 the partial arms 2, 3, 4, 5 of the dual branching DV are continued as in the embodiment according to FIG. 1 by a waveguide mode section 10 extending parallel to the axis of the arrangement. The simple branchings EV are designed as coaxial parallel branchings with coaxial partial arms 12, 13, and 16, 17, being respectively located with regard to their center axis on one line and oriented perpendicularly to the axis of the arrangement. Both coaxial partial arms are connected in each case via a coaxial elbow to a coaxial sidearm 14, 15 and 18, 19 extending at right angle to these partial arms. The one rectangular waveguide section 10 of one opposite pair is transferred with a capacitive probe K1 from its broad side located outside or externally with reference to the longitudinal axis of the arrangement, into the coaxial sidearm 14, while the opposite rectangular waveguide section 10′ is transferred with the same probe coupling from its broad side located on the inside with reference to the longitudinal axis of the arrangement into the second coaxial sidearm 15. With this type of coupling by either waveguide broadside a frequency-independent 180° phase shifting of both waveguide modes with respect to each other is accomplished. That way the coaxial conduits emerging from both waveguides can be fed inphase by a simple low reflection parallel branching of the broadband and coaxial type.

The coupling installation K1 is symmetrical with respect to rotation in this embodiment and may be designed advantageously as a revolving turret, whereby the coaxial sidearms 14, 15 and 18, 19, thereby one coaxial fork in each case, are pivotable about an axis of rotation oriented perpendicularly to the longitudinal axis of the arrangement without changes resulting for both passageways of the polarization switch as to the electric properties and specifically the electrical lengths. Thus, the entire switch according to FIG. 2 is completely symmetrical in its structure.

In the embodiment according to FIG. 2 the length of the coaxial sidearms 14, 15 is so dimensioned that with the adjustment of the one coaxial fork in the direction of the longitudinal axis between the sealing external wall means of the waveguide 10 and/or 10′ and the outside wall means of the coaxial partial arm of the simple branching, sufficient space results for the accommodation of a partial arm of the simple branching associated with the other passageway of the switch oriented at right angles to the coaxial partial arm 12. In such an arrangement the coaxial fork associated with the other passageway then is oriented obliquely to the longitudinal axis of the arrangement at the required identical length of the sidearm, as can be seen from FIG. 2.

A single-endedly broadbandedly adjusted coaxial parallel branching is obtained by making the impedances $Z_p$ of both sidearms 12, 14 and 13 and 15 twice as large as the impedances Z of the coaxial input connection of the simple branching EV. If the coaxial input of the simple branching has a diametrical ratio of $d/D=7/16$ according to $Z=50\Omega$, the impedance $Z_p$ of the sidearms then is to be selected as $100\Omega$, which corresponds to a diametrical relation of the sidearms of $d_p/D=3/16$. In the embodiment according to FIG. 2, the sidearms 14, 15 are transferred in each case via two geometrically identical $100\Omega$ coaxial elbows as well as over equally long $100\Omega$ coaxial conduits into the pair of waveguides 10, 10′. Thus, according to the aforementioned vest-pocket book of high frequency technique, page 421, these transfers to the $100\Omega$ coaxial conduits are more broadbanded than perhaps with a $50\Omega$ conduit, providing the waveguide, as is the case in the embodiment, has approximately a normal profile. Since for the design of coaxial conduit waveguide transfers of maximum band width there exists an optimal coaxial conduit impedance which is between 50 and $100\Omega$, it is advantageous to transfer for example the $100\Omega$ coaxial conduits 12, 13, 14 and 15 with single or multistage coaxial conduit transformers into the optimal coaxial conduit impedance.

The symmetry of each coaxial fork per se is important along with the symmetry of the associated pair of waveguides of the dual branching for the purity of the desired waves in the common circular waveguide arm 1 of the switch, so that for the embodiment according to FIG. 2 a very good purity of the desired waves results, since both coaxial cables of the switch which are symmetrical per se are identical with each other. It is particularly advantageous for the practically attainable degree of identity which together with the practically attainable degree of symmetry of both pairs of waveguides of the dual branch determines the degree of phase synchronism for both switch passageways, to be dependent only on the manufacturing tolerances.

The undisturbed overlapping of both coaxial forks is made possible according to FIG. 2 by pivoting the one fork so far to the side until the exterior conductor of its coaxial partial arm adjoins at the terminal cross-section of a rectangular waveguide section provided with a coaxial transfer. The second coaxial fork is so dimensioned with the length of its leg, which agrees with that of the first fork, that according to FIG. 2 both forks overlap just without interference. The minimum constructional length of the switch results in this case from the length of the double branching plus the length of the subsequent waveguide section 10 and twice the external diameter of the coaxial partial arm of the simple branchings.

It also is imaginable to change the arrangement according to FIG. 2 in such a manner that the coaxial fork of the pair of rectangular waveguides 10, 10' represented horizontally is pivoted so far downward until even the external conductor of its partial arm 13 adheres to the terminal cross-section of the lower rectangular waveguide section of the other passageway. This is accomplished if the coaxial 90° angle pieces following the point of parallel branching are replaced in each case by two 45° angles at a certain distance from each other, which angles are more easily compensable. This signifies a beveling of the corners of the forks. This case results in a minimum overall constructional length of the polarization switch once more reduced by the diameter of the outer conductor of a coaxial partial arm.

Another variant of the arrangement according to FIG. 2 which is not shown separately results by sharply bending the four waveguide switch arms 2, 3, 4, 5 of the dual branching, for example for reasons of mechanical simplification, not toward the longitudinal axis of the arrangement, but if they instead have a continuously straight center axis. Then it is possible to have all four coaxial conduits 14 and 15 and/or 18 and 19 terminating into the waveguide switch arms extend parallel with the broad side of the waveguide switch arms. Then the coaxial conduits 14 and 15 extend as compared to the representation in FIG. 2, twisted by 90° perpendicularly to the longitudinal axis of the arrangement, upward, and have such a length that they slightly protrude beyond the waveguide of the vertical waveguide pair shown in FIG. 2, so that they can be interconnected across the latter via the coaxial switch arms 12 and 13. Accordingly, the coaxial conduit sections 18 and 19 extend at right angles to the axis of the arrangement, forward for example, and they are connected at the anterior end with the coaxial switch arms 16 and 17. This is possible without spacial interference when the coaxial partial arms 12, 13 and/or 16, 17 of the simple branchings have a spacial oblique position relative to the normal plane to the longitudinal axis of the arrangement, so that they do not contact the coaxial conduit sections of the other coaxial fork which terminate into the waveguides.

Figure 3:
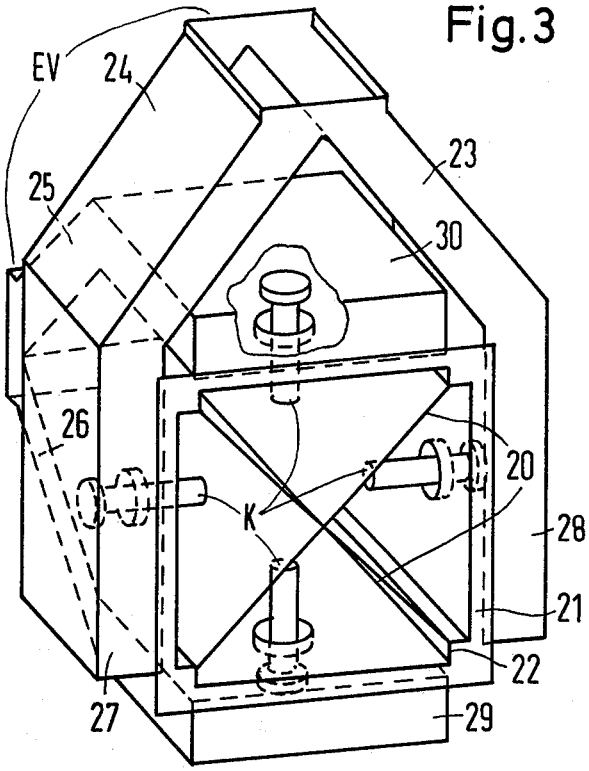
FIG. 3 shows a polarization switch according to the invention with sector-resembling partial hollow conductor cross-sections.

An additional polarization switch symmetrical in design is shown in FIG. 3 which has sector-like partial waveguide cross-sections and which can be derived from the switch according to FIG. 1 in the following manner: For that purpose the four partial arms 2, 3, 4, 5 of the dual branching DV designed as waveguides with rectangular cross-section shall no longer be imagined as extending away obliquely from the longitudinal axis of the arrangement, but now the four waveguides shall extend from the branching point parallel to the longitudinal axis of the arrangement and side by side. Thus the four rectangular waveguides of the dual branching are bent toward the axis. This is possible in an arrangement proximal to the center, without empty spaces in the cross-section, only if the individual waveguide assumes the cross-sectional shape of a triangle in the case of the supplementation to the square waveguide or in case of supplementation to a circular waveguide, (not represented especially in FIG. 3), a sector-like cross-section. The partial arms of the dual branching thus extend parallel side by side and are designed as waveguides with triangular cross-section, whereby adjacent partial arms of the dual branching in each case have a common partition 20 and interior surfaces 21 of the outer walls placed vertically on top of each other.

The waveguides with triangular and/or sector-like cross-section have, according to page 308 of the aforementioned vest-pocket book (handbook) of high frequency technique another (higher) borderline frequency than a square or circular waveguide section from which they are taken. Thus, the four waveguides must, as long as they are separated by diagonal separation panels as common partition from adjacent waveguides, have a larger cross-section than the common waveguide cross-section without partitioning panels. If the common waveguide is circular, its diameter for a broadbandedly impedance correct transition to two triangular waveguides must be smaller than the diagonals in FIG. 3 in which the partitioning panels 20 are located. With square cross-section of the common waveguide, this cross-section is in any event smaller than the square cross-section in the waveguide section provided with partitioning panels. To be able to influence the impedance of the partial waveguides approximately independently of their borderline frequency, square longitudinal rods 22 with variable edge length are applied in the four corners of the divided cross-section according to FIG. 3.

For the compensation of stray reactances of the transition point from the two triangular waveguides located opposite each other in each case to the common round or square waveguide, appropriate measures of an inductive or capacitive nature, for example symmetrical diaphragms or pins are possible without any major problems.

In the embodiment according to FIG. 3, as in the embodiment according to FIG. 1, the simple branchings EV are designed as homogeneously constructed series branches with waveguide partial arms 23, 24 and/or 25, 26 distorted against each other and having a rectangular cross-section. The partial arms of the simple branching are connected in each case with one rectangular waveguide section 27, 28 and/or 29, 30. Two such rectangular waveguide sections 27, 28, and/or 29, 30, associated with such a series branching are oriented parallel with each other in each case and their opposite outer wall means have such a distance that, as shown in FIG. 3, they positively embrace two opposite sides of the square waveguide provided with partitioning panels 20. Now the rectangular waveguide sections 27, 28, and/or 29, 30, located opposite each other in each case are connected via probe couplings K which are identical among each other and which here again may be designed advantageously as mechanical revolving turrets with two partial arms of the dual branching likewise placed opposite each other and presenting a triangular cross-section. To avoid spacial interferences of two series branchings and/or of their partial arms, the series branching provided with the partial arms 23 and 24 is pivoted about the coupling installation as rotary axis oriented perpendicularly to the longitudinal axis of the installation, so that even its axis of symmetry is oriented perpendicularly to the longitudinal axis of the arrangement, while the series branching with the partial arms 25 and 26 is pivoted so that its axis of symmetry coincides with the longitudinal axis of the arrangement.

Figure 4:
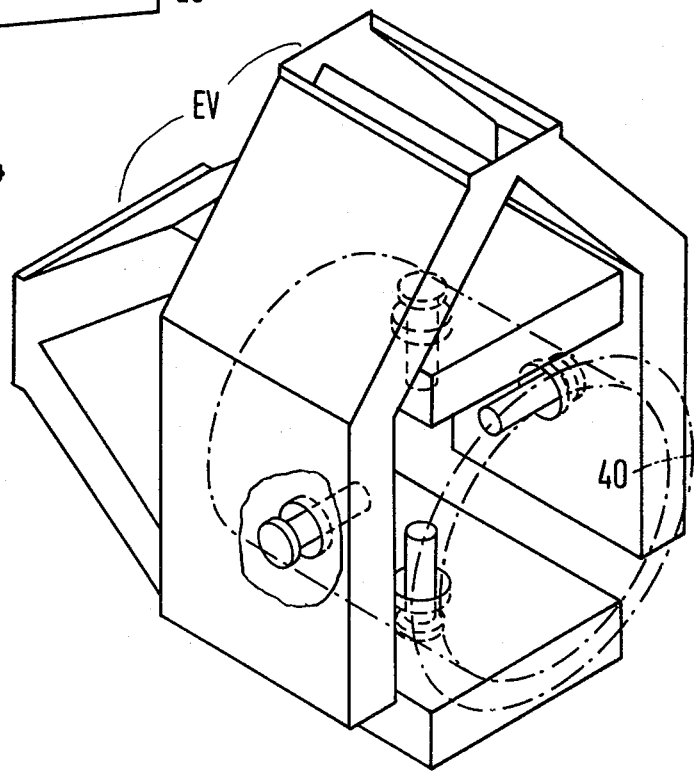
FIG. 4 shows a polarization switch according to the invention with broadband coupling installations.

FIG. 4 shows an additional embodiment of a polarization switch according to the invention which is symmetrical in its design and differs from the embodiment according to FIG. 3 by the square waveguide provided with sectors being replaced by a waveguide with square cross-section and/or circular cross-section which is not divided into individual sectors and/or segments. FIG. 4 schematically shows in dot-dash outline a circular waveguide 40 where both orthogonal polarizations are energized with one diametrically opposite pair of probes in each case in a manner known from prior art, for example according to German Display Copy 1,183,561, whereby the individual probes placed diametrically opposite in the waveguide are to be fed in each case in phase opposed. One pair of probes has as first type of wave interference the $E_{11}$ wave of the circular waveguide ($E_{21}$ wave of the square waveguide) and its range of equivalence in the circular waveguide therefore is: $f_{kE11}:f_{kH11}=2.08:1$. According to this relatively broad range of equivalence, each pair of probes should be adjusted sufficiently broadbandedly in applications of the polarization switch.

The advantage of a complete symmetry also results in the embodiment according to FIG. 4, because four probe couplings are consolidated in pairs with single-ended broadbandedly adjusted waveguide forks for both passageways of the polarization switch, independently of the angle of rotation of electrical and mechanical length.

Figure 5:
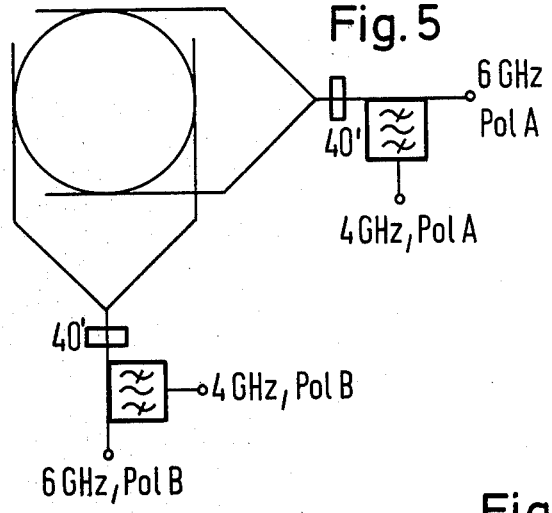
FIG. 5 shows a principal circuit diagram of a polarization switch supplemented to form a phase-symmetrical system switch.

Below two important applications of the phase-symmetrical polarization switches according to the invention shall be explained. One important viewpoint for this is that the polarization switches according to the invention described herein are outstandingly appropriate for the construction of phase-symmetrical system switches in connection with frequency switches. FIG. 5 used for explanation shows a sketch of a phase-symmetrical switch for two frequency ranges. FIG. 5 represents any one of the above explained polarization switches merely schematically as a circuit with two tangentially attacking switch arms combined in each case into a simple branching. The two polarization switches placed vertically on top of each other adapted to be used with waves having polarization A and orthogonal polarization B of two frequency ranges, for example of a four and six GHz range, are combined in the rectangular waveguide 40' (represented schematically in FIG. 5), the latter in each case in one and the same waveguide, with a phase-symmetrical broadband polarization switch according to the invention, either separately or in combination. The combination and/or separation of the four and six-GHz ranges takes place in each case by a frequency switch at either polarization switch arm with rectangular and/or coaxial cross-section. Both frequency switches are identical, so that merely different polarizations of the same frequency range exist at their connections.

Figure 6:
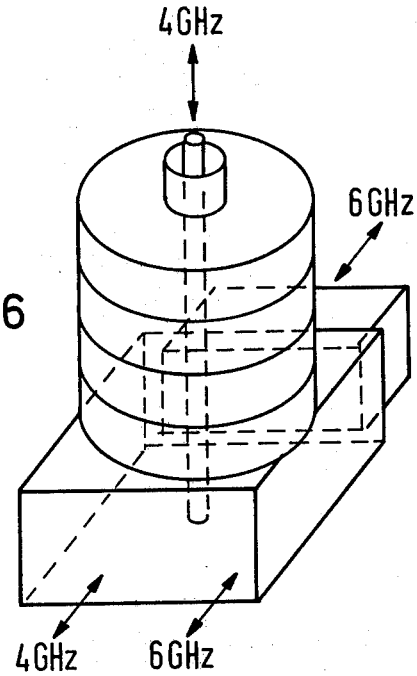
FIG. 6 shows a frequency switch of a simple design.

FIG. 6 shows the diagram of a simple frequency switch appropriate for the application according to FIG. 5 by which a radial circuit block according to German Pat. No. 1,264,636 is coupled with its extended internal conductor, for example in the 4-GHz passage range of this 6-GHz block optimally to the common 4/6 GHz waveguide. This coupling is enhanced by the transition to a 6-GHz waveguide leading axially and rearwardly. For further reduction of the influence of the coupling pin reactance upon the 6-GHz passageway the distance of the 6-GHz short circuit plane of the radial circuit block is measured from the point where the probe dips into the rectangular waveguide with a length of $\lambda/4$.

In the diagram shown in FIG. 5 the functions of the polarization and/or frequency separation are strictly kept apart. This results, particularly as compared to the system switch according to the U.S. Pat. No. 3,978,434, in an advantageous universal possibility of application of the components as phase symmetry axis, broadband polarization switches and/or as frequency switches. This advantage results from the fact that in the polarization switch according to the invention no amalgamation of the functions of polarization and/or frequency separation is necessary.

Figure 7:
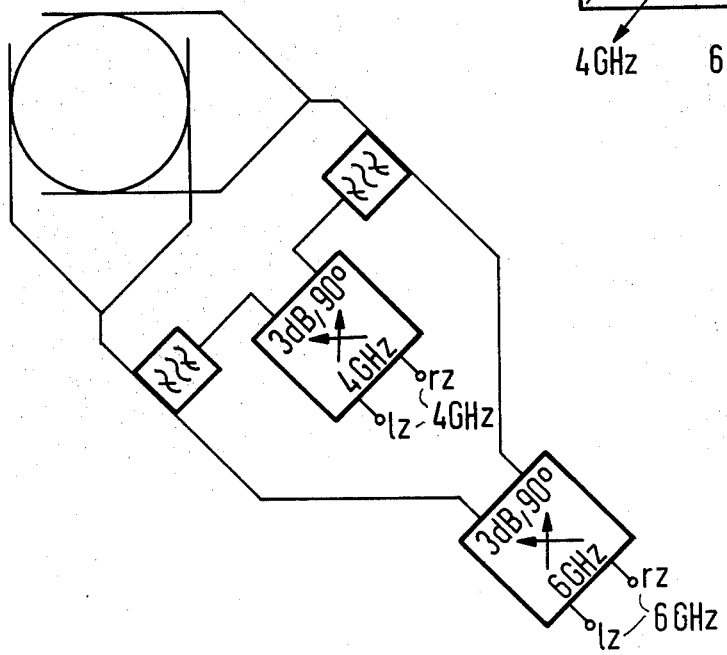
FIG. 7 shows a principal circuit diagram for the application of the polarization switch in an antenna feeder system for circular dual polarization.

The following application of a symmetry switch according to FIG. 5 and explained by means of FIG. 7 is based on its phase symmetry which can be accomplished here without additional expense. Phase symmetry of a system switch according to FIG. 5 means that two equifrequency partial waves pass for example in the entire 4 and 6-GHz range the passageway of the polarization A and the path of the orthogonal polarization B, particularly without phase distortion. As a result of a connection shown in FIG. 7 of both 4-GHz arms of the system switch according to FIG. 5 intended for the polarization of A and/or B with a 3 dB directional coupler for the 4-GHz range and the 6-GHz arms with a 3-dB directional coupler for the 6-GHz range a circuit results with the combined effect explained below.

The one 3-dB directional coupler splits a principal wave into two partial waves which according to page 379 of the aforementioned vest-pocket book (handbook) of high frequency technique show independently of the frequency precisely a reciprocal phase shift of $\pm 90°$. According to this feature offered without additional expense, the sign of the phase angle depends in the arrangement according to FIG. 7 only on which inlet of the 3-dB directional coupler feeds the principal wave, while the amplitudes of the partial waves at appropriate dimensioning of the coupler differ only slightly from each other even at broad individual frequency bands.

If now, according to FIG. 7, both partial waves of the 4-GHz or the 6-GHz directional coupler are fed via two conduits electrically identical and arranged in pair to the circuit part of identical design and as shown in FIG. 5 in the upper part of FIG. 7, on account of its phase symmetry it is traversed by the equifrequency partial waves in each case without phase distortion. These partial waves have, thus for example also in the circular waveguide at the outlet of the polarization switch, and according to FIG. 7, a phase difference of $\pm 90°$ and there as to space they are superposed perpendicularly to each other, because one partial wave traverses the passageway of polarization A and the other one traverses the orthogonal polarization B. Such a constellation of two partial waves precisely corresponds with the left and right-circular wave form respectively of an $H_{11}$ wave.

FIG. 7 thus represents the diagram of an antenna feeder system for circular dual polarization, in the present case in the 4 and 6-GHz range. Thus, depending on the infeeding at one arm or the other one, identified in FIG. 7 by lz and rz respectively of the 3-dB directional coupler for the 6-GHz range, a left and/or right-circularly polarized 6-GHz wave is obtained in the circular waveguide of FIG. 7 at the switch outlet. Analogously, a left and/or right circularly polarized 4-GHz wave originating from the antenna via the circular waveguide of the polarization switch will appear at either connection, lz and/or rz of the 3-dB directional coupler for the 4-GHz range.

Figure 8:
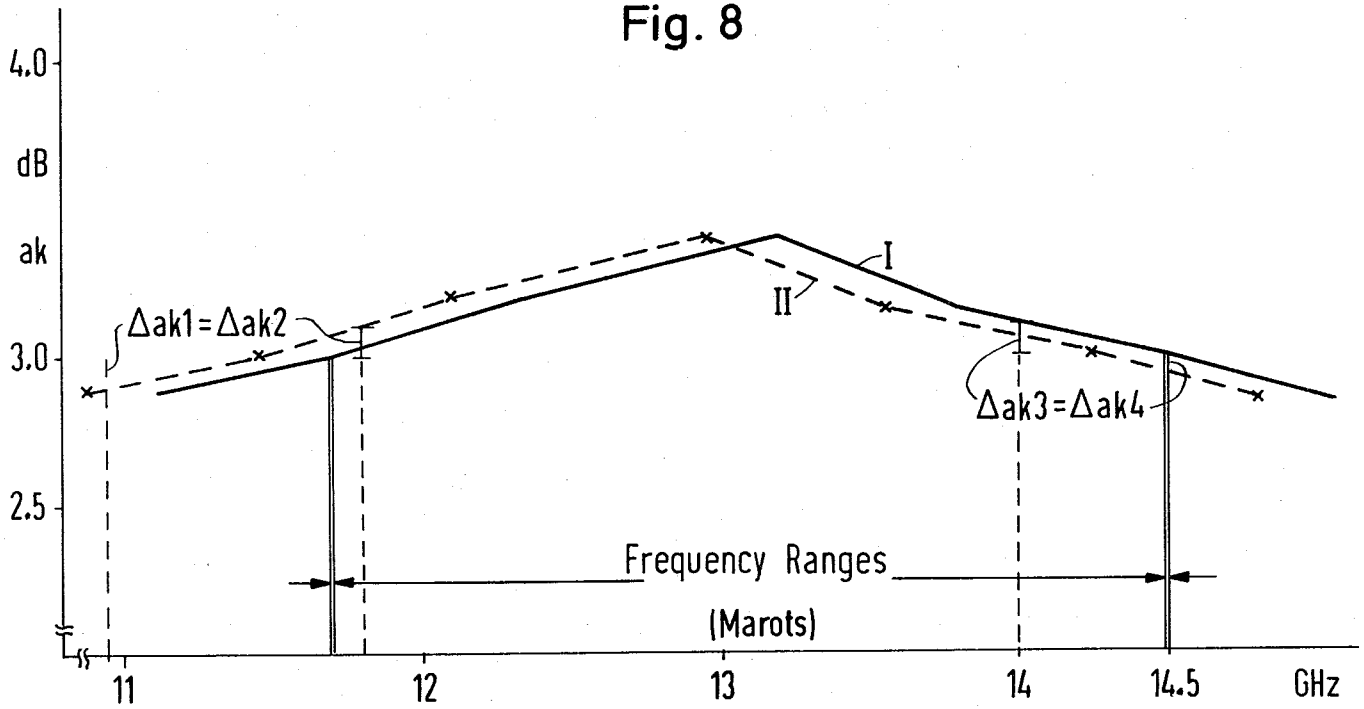
FIG. 8 shows a representation of the coupling attenuation as a function of the frequency for the optimal dimensioning of a 3-dB directional coupling means.

A simplification of the circuit according to FIG. 7 will result as follows for the particular practical case where the transmitting and receiving ranges are narrow and not too far apart from each other (practical example satellite broadcasting system "MAROTS"). For this purpose only an appropriately dimensioned 3-dB coupler is connected, eliminating the frequency switches, to a phase symmetrical polarization switch. The 3-dB directional coupler is so dimensioned in this case, according to FIG. 8, where the coupling attenuation $a_k$ is represented in function of the frequency that the coupler shows in both centers of the narrow transmission and receiving frequencies a coupling attenuation of precisely 3.0103-dB in each case and thus shows together with the precise 90° phase angle ideal properties in the centers of both desired frequency ranges. The maximum of the coupling attenuation of such a directional coupler is located between both desired frequency ranges and the maximum coupling attenuation is higher than 3.0103 d-B. Because of the very slight frequency characteristic of the coupling attenuation according to curve I of FIG. 8 within the narrow transmission and receiving ranges the properties of such a narrow-band feeder system are excellent. Greater deviations from the ideal value of 3.0103-dB result for example in the broader ECS bands of 10.95 GHz to 11.8 GHz and from 14 GHz to 14.5 GHz. At an optimization of the 3-dB coupler feeder systems which still are adequate result on frequency ranges of this width according to curve II of FIG. 8, if the deviations $\Delta_{ak}$ are made identically large in pairs from the ideal value at the four band limits.

It will be apparent that many modifications and variations may be effected without departing from the scope of the novel concepts and teachings of the present invention.

I claim as my invention:

1. A transducer for orthogonally polarized signals including a symmetrically designed branching arrangement having a longitudinal axis, having a longitudinally extending common waveguide providing a common passageway, and having two pairs of dual branching waveguide sections branching from said common waveguide and providing a dual branching from the common passageway, each dual branching waveguide section having one end connecting with said common waveguide and having an opposite end remote from the one end thereof, first and second pairs of switch arm waveguide sections each having one end thereof coupled with the opposite end of one of the dual branching waveguide sections associated therewith, and having an opposite end remote from the one end thereof, and first and second pairs of simple branching waveguide sections each having one end coupled with the opposite end of one of said switch arm waveguide sections associated therewith and having an opposite end remote from the one end thereof, said opposite ends of each pair of simple branching waveguide sections converging to a respective branch passageway, each associated dual branching waveguide section, switch arm waveguide section and simple branching section providing a wave energy path between said common passageway and an associated one of the branch passageways, and the pairs of simple branching waveguide sections being symmetrical with each other, wherein an improvement comprises said switch arm waveguide sections being symmetrical and having respective coupling means which are identical to each other for coupling the wave energy via each switch arm waveguide section between the associated dual branching waveguide section and the associated simple branching waveguide section to provide a completely symmetrical structure and phase synchronization for each of the wave energy paths between said common passageway of the branching arrangement and the respective branch passageways, the dual branching waveguide sections are of rectangular cross-section with a side relation b:a of at least approximately 1:2 to 1:3, the simple branching waveguide sections are of rectangular cross-section, and each of the switch arm waveguide sections is formed by a pair of parallel juxtaposed waveguide sections arranged immediately juxtaposed, said coupling means coupling said juxtaposed waveguide sections and being of such rotation-symmetrical design that the electrical length of the passageways of the arrangement remains intact for different angular relationships between the respective pairs of juxtaposed waveguide sections.

2. The transducer as defined in claim 1, characterized by the respective pairs of juxtaposed waveguide sections being rectangular waveguides superposed at broad sides thereof.

3. A transducer for orthogonally polarized signals including a symmetrically designed branching arrangement having a longitudinal axis, having a longitudinally extending common waveguide providing a common passageway, and having two pairs of dual branching waveguide sections branching from said common waveguide and providing a dual branching from the common passageway, each dual branching waveguide section having one end connecting with said common waveguide and having an opposite end remote from the one end thereof, first and second pairs of switch arm waveguide sections each having one end thereof coupled with the opposite end of one of the dual branching waveguide sections associated therewith, and having an opposite end remote from the one end thereof, and first and second pairs of simple branching waveguide sections each having one end coupled with the opposite end of one of said switch arm waveguide sections associated therewith and having an opposite end remote from the one end thereof, said opposite ends of each pair of simple branching waveguide sections converging to a respective branch passageway, each associated dual branching waveguide section, switch arm waveguide section and simple branching section providing a wave energy path between said common passageway and an associated one of the branch passageways, and the pairs of simple branching waveguide sections being symmetrical with each other, wherein an improvement comprises said switch arm waveguide sections being symmetrical and having respective coupling means which are identical to each other for coupling the wave energy via each switch arm waveguide section between the associated dual branching waveguide section and the associated simple branching waveguide section to provide a completely symmetrical structure and phase synchronization for each of the wave energy paths between said common passageway of the branching arrangement and the respective branch passageways, the dual branching waveguide sections are of rectangular cross-section with a side relation b:a of at least approximately 1:2 to 1:3, the simple branching waveguide sections comprise pairs of coaxial parallel branches formed of pairs of coaxial arm sections and the switch arm waveguide sections comprise in each case a rectangular waveguide connected to the associated dual branching waveguide section and a coaxial sidearm extending parallel and adjacent to the associated rectangular waveguide, each coaxial sidearm is connected on the one hand via an angle piece to one of the coaxial arm sections, and on the other hand the coupling means couples each sidearm to a respective associated rectangular waveguide, and for each of the branch passageways of the arrangement, one associated coaxial siderm is adjacent to one side, located externally with regard to the longitudinal axis of the arrangement, of the associated rectangular waveguide, and the other associated coaxial sidearm is adjacent to the side of the other associated rectangular waveguide located on the inside with regard to the longitudinal axis of the arrangement.

4. The transducer as defined in claim 3, characterized by the fact that each rectangular waveguide is oriented parallel with the longitudinal axis of the arrangement.

5. The transducer as defined in claim 3, characterized by the fact that each rectangular waveguide follows a respective associated dual branching waveguide section rectilinearly essentially parallel to the longitudinal axis.

6. The transducer as defined in claim 3, characterized by the fact that each pair of coaxial arm sections converges to a coaxial port, the coaxial sidearms being so dimensioned that their wave impedances by way of approximation show twice the value of the wave impedances of the coaxial ports.

7. A transducer for orthogonally polarized signals including symmetrically designed branching arrangement havng a longitudinal axis, having a longitudinally extending common passageway, and having two pairs of dual branching waveguide sections branching from said common passageway and providing a dual branching from the common passageway, first and second pairs of coupling waveguide sections each coupling waveguide section being coupled with one of the dual branching waveguide sections associated therewith, and first and second pairs of simple branching waveguide sections each having one end coupled with one of said coupling waveguide sections associated therewith and having an opposite end remote from the one end thereof, said opposite ends of each pair of simple branching waveguide sections converging to a respective branch passageway, each associated dual branching waveguide section, coupling waveguide section and simple branching waveguide section providing a wave energy path between said common passageway and an associated one of the branch passageways, and the pairs of simple branching waveguide sections being symmetrical with respect to each other, wherein an improvement comprises said coupling waveguide sections being symmetrical and having respective coupling means which are identical to each other for coupling of wave energy between each dual branching waveguide section and the associated simple branching waveguide section via the associated coupling waveguide section to provide a completely symmetrical structure and phase synchronization for each of the wave energy paths between said common passageway of the branching arrangement and the respective branch passageways, and wherein the dual branching waveguide sections comprise respective pairs of arm sections which extend parallel side by side and are designed as waveguides of generally triangular cross-section, that adjacent arm sections in each case have a joint partition and outer walls placed generally perpendicularly to each other, that the simple branching waveguide sections are of rectangular cross-section, and that the coupling waveguide sections are rectangular waveguide sections arranged with one of their broad sides in each case adjacent to opposite pairs of outer walls of the arm sections.

8. A transducer for orthogonally polarized signals including a symmetrically designed branching arrangement having a longitudinal axis, having a longitudinally extending common waveguide providing a common passageway, and having two pairs of dual branching waveguide sections branching from said common waveguide and providing a dual branching from the common passageway, each dual branching waveguide section having one end connecting with said common waveguide and having an opposite end remote from the one end thereof, first and second pairs of switch arm waveguide sections each having one end thereof coupled with the opposite end of one of the dual branching waveguide sections associated therewith, and having an opposite end remote from the one end thereof, and first and second pairs of simple branching waveguide sections each having one end coupled with the opposite end of one of said switch arm waveguide sections associated therewith and having an opposite end remote from the one end thereof, said opposite ends of each pair of simple branching waveguide sections converging to a respective branch passageway, each associated dual branching waveguide section, switch arm waveguide section and simple branching section providing a wave energy path between said common passageway and an associated one of the branch passageways, and the pairs of simple branching waveguide sections being symmetrical with each other, wherein an improvement comprises said switch arm waveguide sections being symmetrical and having respective coupling means which are identical to each other for coupling the wave energy via each switch arm waveguide section between the associated dual branching waveguide section and the associated simple branching waveguide section to provide a completely symmetrical structure and phase synchronization for each of the wave energy paths between said common passageway of the branching arrangement and the respective branch passageways, each coupling means is designed as a mechanical revolving turret and oriented vertically to the longitudinal axis of the arrangement, with regard to its axis of rotation.

9. An improved transducer for use with directional or satellite broadcasting systems, the transducer has a first longitudinally extending waveguide connected to a first end of second, third, fourth and fifth waveguides oriented at 90° with respect to each other, and at a selected angle with respect to the longitudinal extending waveguide, the first through fifth waveguides form a dual branch, a plurality of switch arm sections, one switch arm section is connected to a second end of each of the second through fifth waveguides, first and second simple branches oriented at a selected angle with respect to each other, and formed from a sixth and seventh connected waveguide and an eighth and a ninth connected waveguide respectively, ends of the sixth and seventh waveguides are connected to switch arm sections attached to the second and fourth waveguides respectively, ends of the eighth and ninth waveguides are connected to switch arm sections attached to the third and fifth waveguides respectively, the improvement comprising:

a plurality of means for coupling, each of said means for coupling is mounted within one of the switch arm sections to provide electrically symmetrical, phase synchronized, simple branches, each of said second through said fourth waveguides has a rectangular cross section with a shorter side and a lower side, said two sides have a ratio selected from a range of ½ to ⅓ and wherein, said simple branches comprise series branches, each of said sixth to ninth waveguides has a rectangular cross section and wherein each said switch arm section comprises first and second, adjacent, parallel waveguide sections connected by one of said means for coupling and wherein, each of said means for coupling is symmetrical such that rotation of said first and second parallel waveguide sections does not alter said electrically symmetrical, phase synchronized, character of said simple branches.

10. The improved transducer according to claim 9 wherein:

said first and second adjacent parallel waveguide sections are each formed as a rectangular waveguide with an elongated side, said rectangular waveguides are oriented with said elongated sides adjacent one another.

11. An improved transducer for use with directional or satellite broadcasting systems, the transducer has a first longitudinally extending waveguide connected to a first end of second, third, fourth and fifth waveguides oriented at 90° with respect to each other, and at a selected angle with respect to the longitudinal extending waveguide, the first through fifth waveguides form a dual branch, a plurality of switch arm sections, one switch arm section is connected to a second end of each of the second through fifth waveguides, first and second simple branches oriented at a selected angle with respect to each other, and formed from a sixth and seventh connected waveguide and an eighth and ninth connected waveguide respectively, ends of the sixth and seventh waveguides are connected to switch arm sections attached to the second and fourth waveguides respectively, ends of the eighth and ninth waveguides are connected to switch arm sections attached to the third and fifth waveguides respectively, the improvement comprising:

a plurality of means for coupling, each of said means for coupling is mounted within one of the switch arm sections to provide electrically symmetrical, phase synchronized, simple branches, each of said second through said fourth waveguides has a rectangular cross section with a shorter side and a longer side, said two sides have a ratio selected from a range of ½ to ⅓, and wherein said sixth through said ninth waveguides each comprise a coaxial waveguide, and wherein each said switch arm section comprises a rectangular waveguide wherein each said means for coupling connects an end of one of said coaxial waveguides, to a selected side of one of said rectangular waveguides forming said switch arm section.

12. The improved transducer according to claim 11 wherein:

each said rectangular waveguide is oriented parallel with the longitudinally extending waveguide.

13. The improved transducer according to claim 11 wherein:

each of said simple branches is connected to a selected exterior surface of a first of said rectangular waveguides and is connected to a selected interior surface of a second of said rectangular waveguides.

14. The improved transducer according to claim 11 wherein each said coaxial waveguide has a first part, adjacent one of said means for coupling, with a wave impedance of a value approximately twice the value of the wave impedance of the remainder of said coaxial waveguide.

15. A transducer for use with directional or satellite broadcasting systems comprising:

means for forming a dual branch including a plurality of parallel, adjacent, waveguides of a selected cross section;

a plurality of coupling means connected to and equally spaced about said plurality of parallel, adjacent waveguides;

first and second series-type simple branches, each said simple branch is formed of first and second waveguides joined together at a first end to form a generally U-shaped structure;

said first and second waveguides of said first simple branch are each connected, at a second end, to first and second of said coupling means, said first and second waveguides of said second simple branch are each connected, at a second end, to third and fourth of said coupling means, said plurality of parallel adjacent waveguides comprises four waveguides each having an identical triangular cross section and said plurality of coupling means comprises four coupling means, oriented at substantially 90° apart with each coupling means connected to a different one of said four waveguides, and said first simple branch is connected to two of said means for coupling oriented 180° apart and said second simple branch is connected to the other two of said means for coupling.

* * * * *